US011062644B2

(12) United States Patent
Tai et al.

(10) Patent No.: US 11,062,644 B2
(45) Date of Patent: Jul. 13, 2021

(54) DISPLAY DEVICE

(71) Applicant: E Ink Holdings Inc., Hsinchu (TW)

(72) Inventors: Sheng-Chieh Tai, Hsinchu (TW); Yu-Nan Pao, Hsinchu (TW); Hsin-Tao Huang, Hsinchu (TW); Yi-Pai Huang, Hsinchu (TW); Fang-Cheng Lin, Hsinchu (TW); Chi-Wen Chang, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 16/004,450

(22) Filed: Jun. 11, 2018

(65) Prior Publication Data

US 2019/0080644 A1 Mar. 14, 2019

(30) Foreign Application Priority Data

Sep. 14, 2017 (CN) ..... 201710828767.7

(51) Int. Cl.

| | |
|---|---|
| ***G09G 5/10*** | (2006.01) |
| ***G09G 3/32*** | (2016.01) |
| ***G09G 3/20*** | (2006.01) |
| ***G09G 3/34*** | (2006.01) |

(52) U.S. Cl.

CPC ..... *G09G 3/32* (2013.01); *G09G 3/2003* (2013.01); *G09G 3/3426* (2013.01); *G09G 3/3473* (2013.01); *G09G 2320/0242* (2013.01); *G09G 2320/0646* (2013.01)

(58) Field of Classification Search

None

See application file for complete search history.

(56) References Cited

U.S. PATENT DOCUMENTS

| | | | |
|---|---|---|---|
| 7,683,857 | B2 | 3/2010 | Yoshida |
| 2002/0070914 | A1 | 6/2002 | Bruning et al. |

(Continued)

FOREIGN PATENT DOCUMENTS

| | | | |
|---|---|---|---|
| CN | 1808559 | A | 7/2006 |
| CN | 100370350 | C | 2/2008 |

(Continued)

OTHER PUBLICATIONS

Corresponding Taiwan office action dated Sep. 23, 2019.
Corresponding Chinese office action dated Dec. 27, 2019.
Corresponding Chinese office action dated Jul. 8, 2020.

*Primary Examiner* — Carl Adams

(74) *Attorney, Agent, or Firm* — CKC & Partners Co., LLC

(57) ABSTRACT

A display device includes a display panel, a light source module and a control unit. The display panel includes plural display areas. The light source module includes plural light source units. The light source units are configured to output plural light beams to illuminate the display areas of the display panel. The control unit is coupled to the light source module and configured to receive a frame data. The frame data includes plural subframe data, and the subframe data are displayed on the display areas. The control unit is further configured to control a first light source unit of the light source units to adjust a brightness corresponding to a first color of a first light beam of the light beams according to a ratio of the first color. The ratio of the first color is related to a first subframe data of the subframe data.

8 Claims, 5 Drawing Sheets

(56) References Cited

U.S. PATENT DOCUMENTS

| | | | | |
|---|---|---|---|---|
| 2009/0154198 | A1* | 6/2009 | Lee | G02B 6/0081 362/624 |
| 2010/0007589 | A1 | 1/2010 | Yeo et al. | |
| 2012/0293571 | A1* | 11/2012 | Gotoh | G09G 3/3413 345/690 |
| 2013/0141406 | A1 | 6/2013 | White | |
| 2013/0141452 | A1 | 6/2013 | White | |
| 2014/0043353 | A1* | 2/2014 | Ishihara | G09G 3/3426 345/589 |
| 2018/0151104 | A1* | 5/2018 | Heo | G09G 3/2077 |

FOREIGN PATENT DOCUMENTS

| | | | |
|---|---|---|---|
| CN | 101201470 | A | 6/2008 |
| CN | 101853644 | A | 10/2010 |
| CN | 102741912 | A | 10/2012 |
| CN | 102956218 | A | 3/2013 |
| EP | 1734502 | A1 | 12/2006 |
| TW | 200830239 | A | 7/2008 |
| TW | 201401892 | A | 1/2014 |
| TW | 201510977 | A | 3/2015 |
| TW | I503812 | B | 10/2015 |
| TW | 201635262 | A | 10/2016 |

* cited by examiner

DISPLAY DEVICE

RELATED APPLICATIONS

This application claims priority to Chinese Application Serial Number 201710828767.7, filed Sep. 14, 2017, which is herein incorporated by reference.

BACKGROUND

Technical Field

The present disclosure relates to display technology. More particularly, the present disclosure relates to a display device.

Description of Related Art

In general, a light source of a reflective display outputs white light, and can only adjust brightness. However, in a situation of displaying color image, color saturation of display is therefore limited so that it is difficult to display frame with high color saturation.

SUMMARY

An aspect of the present disclosure is to provide a display device that includes a display panel, a light source module and a control unit. The display panel includes a plurality of display areas. The light source module includes a plurality of light source units. The light source units are configured to output a plurality of light beams to illuminate the display areas of the display panel. The control unit is coupled to the light source module and configured to receive a frame data. The frame data includes a plurality of subframe data. The subframe data are displayed on the display areas. The control unit is further configured to control a first light source unit of the light source units to adjust a brightness corresponding to a first color of a first light beam of the light beams according to a ratio of the first color. The ratio of the first color is related to a first subframe data of the subframe data.

In an embodiment, the control unit is further configured to control the first light source unit to increase the brightness corresponding to the first color of the first light beam when the control unit determines that the ratio of the first color of the first subframe data is larger than a threshold.

In an embodiment, the control unit is further configured to control a second light source unit of the light source units to adjust a total brightness of a second light beam of the light beams according to a ratio of the second color, and the ratio of the second color is related to a second subframe data of the subframe data.

In an embodiment, the control unit is further configured to control the second light source unit to reduce the total brightness of the second light beam when the control unit determines that the ratio of the second color of the second subframe data is larger than a threshold.

In an embodiment, the first light source unit comprises a red-green-blue (RGB) light emitting diode (LED). The control unit is further configured to control the RGB LED of the first light source unit to adjust the brightness corresponding to the first color of the first light beam according to the ratio of the first color of the first subframe data.

In an embodiment, the display device further includes a projection unit. The projection unit is configured to project the light beams outputted by the light source units on the display areas of the display panel.

Another aspect of the present disclosure is to provide a display device that includes a light guide, a light source module and a control unit. The light source module is configured to output a light beam to illuminate the light guide. The control unit is coupled to the light source module and configured to receive a frame data, and to control the light source module to adjust a brightness corresponding to a first color of the light beam according to a ratio of the first color, wherein the ratio of the first color is related to the frame data.

In an embodiment, the control unit is further configured to control the light source module to increase the brightness corresponding to the first color of the light beam when the control unit determines that the ratio of the first color of the frame data is larger than a threshold.

In an embodiment, the light source module comprises a red-green-blue (RGB) light emitting diode (LED), and the control unit is further configured to control the RGB LED of the light source module to adjust the brightness corresponding to the first color of the light beam according to the ratio of the first color of the frame data.

In an embodiment, the display device further includes a first adhesivelayer and a second adhesivelayer. The light guide is disposed between the first adhesivelayer and the second adhesive layer, and the refractive index of the light guide is larger than the refractive index of the first adhesive layer and the refractive index of the second adhesive layer.

In sum, the control unit can adjust a brightness corresponding to a color of the light beam outputted by the light source module according to a ratio of a color of the frame data, and therefore color saturation of the frame data is effectively improved.

It is to be understood that both the foregoing general description and the following detailed description are by examples, and are intended to provide further explanation of the present disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

In order to make the description of the disclosure more detailed and comprehensive, reference will now be made in detail to the accompanying drawings and the following embodiments. However, the provided embodiments are not used to limit the ranges covered by the present disclosure; orders of step description are not used to limit the execution sequence either. Any devices with equivalent effect through rearrangement are also covered by the present disclosure.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise indicated, all numbers expressing quantities, conditions, and the like in the instant disclosure and claims are to be understood as modified in all instances by the term "about." The term "about" refers, for example, to numerical values covering a range of plus or minus 20% of the numerical value. The term "about" preferably refers to numerical values covering range of plus or minus 10% (or most preferably, 5%) of the numerical value. The modifier "about" used in combination with a quantity is inclusive of the stated value.

In this document, the term "coupled" may also be termed as "electrically coupled," and the term "connected" may be termed as "electrically connected." "Coupled" and "connected" may also be used to indicate that two or more elements cooperate or interact with each other.

Figure 1:
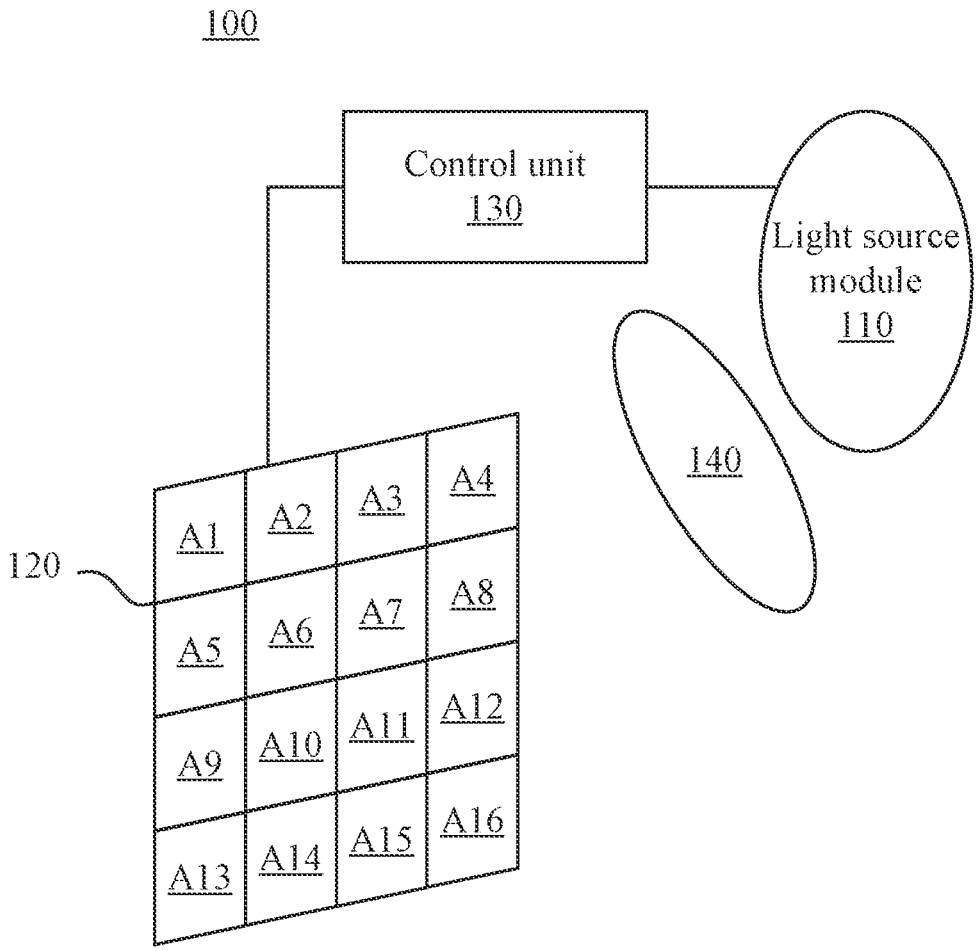
FIG. 1 is a schematic diagram of a display device according to an embodiment of the present disclosure.
Figure 2:
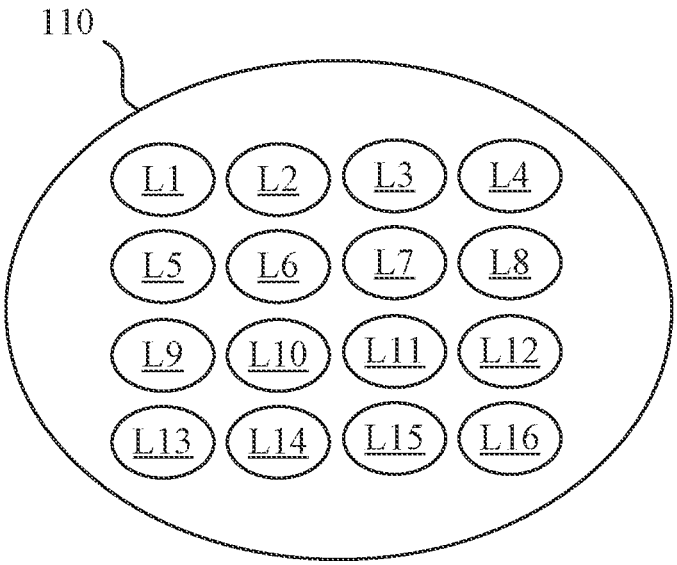
FIG. 2 is a schematic diagram of a light source module of a display device according to an embodiment of the present disclosure.

Reference is made to FIG. 1 and FIG. 2. FIG. 1 is a schematic diagram of a display device 100 according to an embodiment of the present disclosure. FIG. 2 is a schematic diagram of a light source module 110 of a display device 100 according to an embodiment of the present disclosure. The display device 100 includes a light source module 110, a display panel 120 and a control unit 130. The display panel 120 includes plural display areas A1-A16. The light source module 110 includes plural light source units L1-L16. The light source unit L1-L16 is configured to output plural light beams to illuminate the display area A1-A16 of the display panel 120. The control unit 130 is coupled to the light source module 110 and configured to receive frame data. The frame data includes a plurality of subframe data, and the plurality of subframe data are respectively displayed on the display areas A1-A16.

In one embodiment, the light source units L1-L16 respectively illuminate the display areas A1-A16. For example, a light beam outputted by the light source unit L1 illuminates the display area A1, a light beam outputted by the light source unit L2 illuminates the display area A2, . . . a light beam outputted by the light source unit L16 illuminates the display area A16. It should be noted that number and arrangement of the display areas A1-A16 in FIG. 1 are merely for example, and other arrangements of the display areas A1-A16 are also within the scope of the present disclosure. However, the present disclosure is not limited herein.

In one embodiment, the light source units L1-L16 include a red-green-blue (RGB) light emitting diode (LED). In another embodiment, the light source units L1-L16 may include a RGB LED and a white LED.

In one embodiment, the frame data may be color frame data. The control unit 130 is configured to control a first light source unit of the light source units L1-L16 to adjust a brightness corresponding to the first color of a first light beam of the light beams according to a ratio of the first color. The ratio of the first color is related to first subframe data of plural subframe data. For example, the control unit 130 controls the light source unit L1 to adjust a brightness corresponding to red color of a light beam illuminated to the display area A1 according to a ratio of red color of subframe data displayed on the display area A1.

Figure 5:
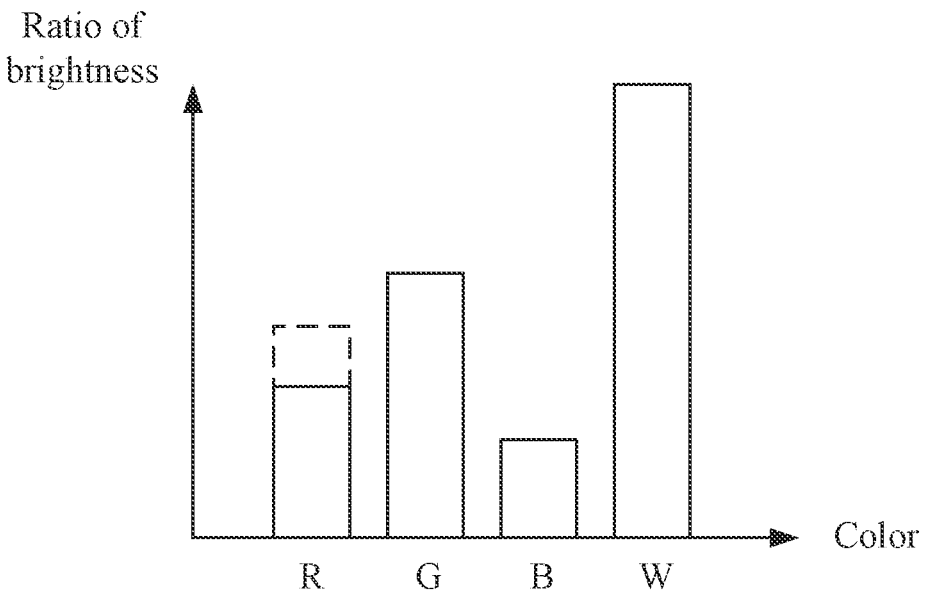
FIG. 5 is a schematic diagram of brightness of light beams illuminated by a light source module on a light guide according to an embodiment of the present disclosure.

In one embodiment, when the control unit 130 determines that the ratio of red color of the subframe data displayed on the display area A1 is larger than a threshold (designed according to actual demand), the control unit 130 controls the light source unit L1 to increase the brightness corresponding to red color of the light beam illuminated to the display area A1. Reference is made to FIG. 5 and FIG. 1, light beams of the light source module 110 illuminated the display panel 120 are shown, before adjustment, a brightness R of red color, a brightness G of green color, a brightness B of blue color, and a brightness W of white color are shown by solid lines, and a brightness R of red color increased by the light source unit L1 that is controlled by the control unit 130 is shown by dashed lines. When the control unit 130 determines that the ratio of red color of the subframe data (not shown) displayed on the display area A1 is higher, the brightness R of red color of the light beam illuminated the display area A1 by the light source unit L1 is also increased, and therefore color saturation of the display area A1 is effectively improved.

It should be noted that the control unit 130 may detect ratios of plural colors (e.g., red color, green color, blue color, however, the present disclosure is not limited herein) of the plural subframe data displayed on the display areas A1-A16 to control the light source units L1-L12 to adjust plural brightness corresponding to the colors (e.g., red color, green color, blue color, however, the present disclosure is not limited herein) of the light beams. For example, when the control unit 130 determines that a ratio of green color of subframe data displayed on the display area A3 is larger than a threshold (designed according to actual demand), the control unit 130 controls the light source unit L3 to increase a brightness corresponding to green color of the light beam illuminated the display area A3. For another example, when the control unit 130 determines that a ratio of blue color of subframe data displayed in the display area A5 is larger than a threshold (designed according to actual demand), the control unit 130 controls the light source unit L5 to increase a brightness corresponding to blue color of light beam illuminated the display area A5. Similarly, the control unit 130 controls each of the light source units L1-L12 to adjust the brightness corresponding to the colors (e.g., red color, green color, blue color, however, the present disclosure is not limited herein) of the output light beams according to the ratios of the plural colors (e.g., red color, green color, blue color, however, the present disclosure is not limited herein) of the plural subframe data displayed on the display areas A1-A16.

As a result, the control unit 130 may control the light source units L1-L16 to respectively adjust the brightness of the output light beams to improve color saturation of the subframe data displayed on the display areas A1-A16, and therefore display quality is effectively improved.

In another embodiment, the frame data may be gray-level frame data. The control unit 130 is further configured to control a second light source unit of the light source units L1-L16 to adjust a total brightness of a second light beam of the light beams according to a ratio of a second color. The ratio of the second color is related to second subframe data of the plural subframe data. For example, the control unit 130 controls the light source unit L2 to adjust a total brightness of a light beam illuminated the display area A2 according to a ratio of black color of subframe data displayed on the display area A2.

In one embodiment, when the control unit 130 determines that the ratio of black color of the subframe data displayed on the display area A2 is larger than a threshold (designed according to actual demand), the control unit 130 controls the light source unit L2 to reduce a total brightness (e.g., brightnesses of red color, green color, blue color and white color) of a light beam illuminated the display area A2. When the subframe data with higher ratio of black color is displayed on the display area A2, the total brightness of the light beam illuminated the display area A2 by the light source unit L2 are all reduced. Similarly, the control unit 130 controls each of the light source units L1-L16 to adjust total brightness of the output light beams according to a ratio of black color of each of the plural subframe data displayed on the display areas A1-A16, and therefore contrast of the display areas A1-A16 is effectively improved.

In one embodiment, the display device 100 further includes a projection unit 140. The projection unit 140 is configured to project the light beams outputted by the light source units L1-L16 to the display areas A1-A16 of the display panel 120. For example, the projection unit 140 is configured to project the outputted by the light source unit L1 to the display area A1, to project the light beam outputted by the light source unit L2 to the display area A2, . . . to project the light beam outputted by the light source unit L16 to the display area A16. It should be noted that arrangement of the display areas A1-A16 in FIG. 1 is only for example, other arrangements of the display areas A1-A16 are also within the scope of the present disclosure. The projection unit 140 may project the light beams outputted by the light source units L1-L16 to the display areas A1-A16 with different arrangements.

Figure 3:
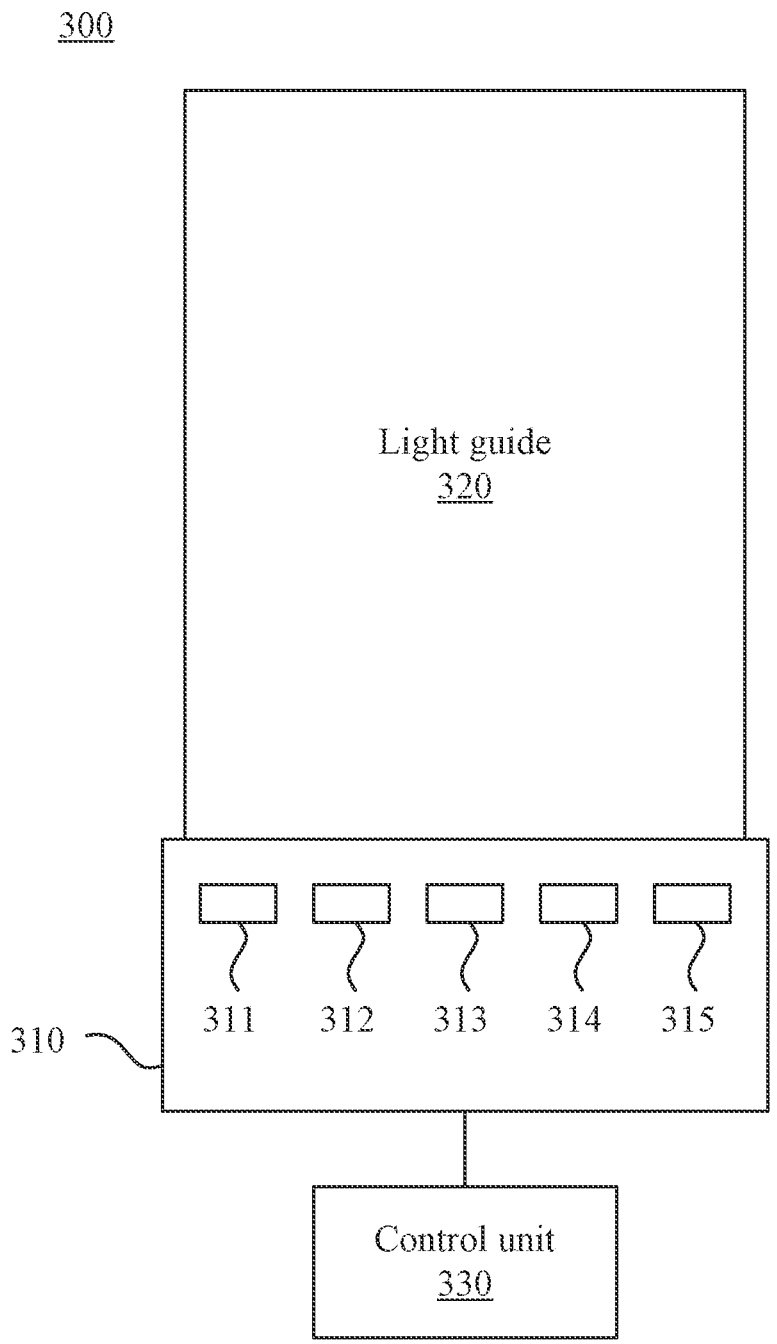
FIG. 3 is a schematic diagram of a display device according to an embodiment of the present disclosure.

Reference is made to FIG. 3. FIG. 3 is a schematic diagram of a display device 300 according to an embodiment of the present disclosure. The display device 300 includes a light source module 310, a light guide (LGP) 320 and a control unit 330. The light source module 310 is configured to output a light beam to illuminate the light guide 320. The control unit 330 is coupled to the light source module 310.

In one embodiment, frame data may be color frame data. The control unit 330 is configured to receive the frame data, and to control the light source module 310 to adjust a brightness corresponding to a first color of the light beam according to a ratio of a first color. The ratio of the first color is related to the frame data. For example, the control unit 330 controls the light source module 310 to adjust a brightness corresponding to red color of the light beam according to a ratio of red color of the frame data.

In one embodiment, when the control unit 330 determines that the ratio of red color of the frame data is larger than a threshold (designed according to actual demand), the control unit 330 controls the light source module 310 to increase the brightness corresponding to red color of the light beam illuminated the light guide 320. Reference is made to FIG. 5, before adjustment, a brightness R of red color, a brightness G of green color, a brightness B of blue color and a brightness W of white color are shown in solid lines, and a brightness R of red color increased by the light source unit 310 that is controlled by the control unit 330 is shown by dashed lines. When the control unit 330 determines that the ratio of red color of the frame data (not shown) is higher, the brightness R of red color of the light beam illuminated the light guide 320 by the light source module 310 is also increased, and therefore color saturation is effectively improved. It should be noted that when the control unit 330 determines that a ratio of another color (e.g., green color, blue color) of the frame data is larger than a threshold (designed according to actual demand), the control unit 330 controls the light source module 310 to increase a brightness of the other color (e.g., green color, blue color) of light beam illuminated the light guide 320.

As a result, the control unit 330 may control the light source module 310 to adjust the brightness of the output light beam to improve color saturation of the frame data, and therefore display quality is effectively improved.

In one embodiment, the light source module 310 includes RGB LEDs 312, 314 and white LEDs 311, 313 and 315. In another embodiment, the light source module 310 includes a RGB LED. The control unit 330 is further configured to control a first color LED of the light source module 310 to adjust a brightness corresponding to the first color of the light beam illuminated the light guide 320 according to a ratio of first color of the frame data. For example, the control unit 330 is further configured to control the RGB LEDs 312, 314 of the light source module 310 to adjust a brightness corresponding to red color of the light beam illuminated the light guide 320 according to a ratio of red color of the frame data.

Figure 4:
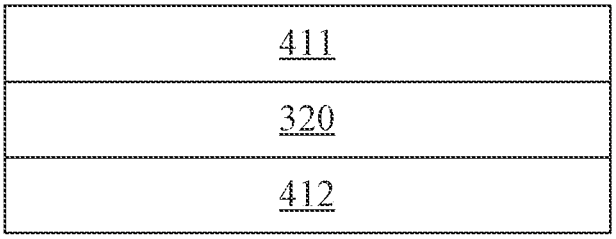
FIG. 4 is a schematic diagram of a light guide of a display device according to an embodiment of the present disclosure.

In one embodiment, as shown in FIG. 4, the light guide 320 is disposed between an adhesive layer 410 and an adhesive layer 420. The refractive index of the light guide 320 is larger than the refractive index of the adhesive layer 411, and the refractive index of the light guide 320 is larger than the refractive index of the adhesive layer 412. In one embodiment, the adhesive layer 411 and the adhesive layer 412 are optical clear adhesive (OCA), and an AG film, a cover plate or a touch panel may be laminated on the adhesive layer 411. In another display device, only the bottom adhesive layer 412 is connected to a reflective display, a cover plate (or a touch panel) is disposed on a light guide, and an air layer is between the light guide and the cover plate (or the touch panel).

In practice, the control units 130 and 330 may be circuits.

In sum, the control units 130 and 330 can adjust the brightness corresponding to colors of the light beams outputted by the light source module 110 and 310 according to the ratios of the colors of the frame data, and therefore color saturation of the frame data is effectively improved.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A reflective display device, comprising:

a display panel, comprising a plurality of display areas;

a light source module, comprising:

a plurality of light source units, configured to output a plurality of light beams to illuminate the display areas of the display panel respectively, wherein the light source units are corresponding to the light beams and the display areas in a one-to-one manner, and a first light source unit of the light source units is configured to output a first light beam of the light beams to illuminate a first display area of the display areas; and a control unit, coupled to the light source module and configured to receive a frame data, wherein the frame data comprises a plurality of subframe data that are displayed on the display areas in a one-to-one manner, wherein the light source units are external to the display panel to additionally emit light to the display areas of the display panel while the subframe data are displayed in the display areas, wherein a plurality of display colors are displayed on the first display area according to a first subframe data of the subframe data, and a first color of the display colors occupies a first area of the first display area;

wherein the control unit is further configured to control the first light source unit to increase a brightness of the first color in the first display area when the control unit determines that an area ratio of the first area to the first display area is greater than a threshold, wherein the first light color comprises red, green, blue, or white.

2. The display device of claim 1, wherein a second light source unit of the light source units is configured to output a second light beam of the light beams to illuminate a second display area of the display areas;

a plurality of display colors are displayed on the second display area according to a second subframe data of the subframe data, and a second color of the display colors occupies a second area of the second display area;

the control unit is configured to control the second light source unit of the light source units to adjust a total brightness of the second light beam of the light beams according to an area ratio of the second area to the second display area.

3. The display device of claim 2, wherein the control unit is configured to control the second light source unit to reduce the total brightness of the second light beam when the control unit determines that the area ratio of the second area to the second display area is larger than a threshold, wherein the second color comprises black.

4. The display device of claim 1, wherein the first light source unit comprises a red-green-blue (RGB) light emitting diode (LED), and the control unit is configured to control the RGB LED of the first light source unit to adjust the brightness corresponding to the first color of the first light beam according to the area ratio of the first area to the first display area.

5. The display device of claim 1, further comprising:

a projection unit, configured to project the light beams outputted by the light source units on the display areas of the display panel.

6. A reflective display device, comprising:

a light guide;

a light source module, configured to output a light beam to illuminate the light guide; and a control unit, coupled to the light source module and configured to receive a frame data, wherein a plurality of display colors are displayed on a display area of the light guide according to the frame data, and a first color of the display colors occupies a first area of the display area, and wherein the light source units are external to the light guide to additionally emit light to the display area of the light guide while the frame data is displayed in the display area;

wherein the control unit is further configured to control the light source module to increase a brightness of the first color in the first area when the control unit determines that an area ratio of the first area to the display area of the light guide is greater than a threshold, the first light color comprising red, green, blue, or white.

7. The display device of claim 6, wherein the light source module comprises a red-green-blue (RGB) light emitting diode (LED), and the control unit is configured to control the RGB LED of the light source module to adjust the brightness corresponding to the first color of the light beam according to the area ratio of the first area to the first display area.

8. The display device of claim 6, further comprising:

a first adhesive layer; and a second adhesive layer, wherein the light guide is disposed between the first adhesive layer and the second adhesive layer, and the refractive index of the light guide is larger than the refractive index of the first adhesive layer and the refractive index of the second adhesive layer.

* * * * *